United States Patent [19]

Castagnoli

[11] Patent Number: 5,074,596

[45] Date of Patent: Dec. 24, 1991

[54] CURRENCY PAPER, ESPECIALLY BANK NOTE, WITH A SAFETY DESIGN AND PROCESS FOR PRODUCING IT

[75] Inventor: Rinaldo Castagnoli, Lausanne, Italy

[73] Assignee: De La Rue Giori S.A., Switzerland

[21] Appl. No.: 478,481

[22] Filed: Feb. 12, 1990

[30] Foreign Application Priority Data

Feb. 23, 1989 [CH] Switzerland ..... 664/89

[51] Int. Cl.[5] ..... B42D 15/00

[52] U.S. Cl. ..... 283/91; 283/58; 283/902

[58] Field of Search ..... 283/91, 58, 901, 902, 283/85, 93, 114

[56] References Cited

U.S. PATENT DOCUMENTS

| | | | |
|---|---|---|---|
| 4,033,059 | 7/1977 | Hutton et al. | 283/91 |
| 4,588,212 | 5/1986 | Castagnoli | 283/91 |
| 4,715,623 | 12/1987 | Roule et al. | 283/85 X |

FOREIGN PATENT DOCUMENTS

| | | | |
|---|---|---|---|
| 2401251 | 9/1974 | Fed. Rep. of Germany | 283/902 |
| 243789 | 12/1925 | United Kingdom | 283/902 |
| 2018197 | 10/1979 | United Kingdom | 283/58 |

*Primary Examiner*—Paul A. Bell

*Attorney, Agent, or Firm*—Kane Dalsimer Sullivan Kurucz Levy Eisele and Richard

[57] ABSTRACT

The safety design printed on a currency paper is composed, on the one hand, of a basic design with parallel lines (10, 20, 30) extending in a specific direction, with a plurality of interruptions, by means of which regions in the form of letters are marked out, and of a plurality of line segments (1, 11, 21) which fill these regions. A plurality of groups (R to Z) of letters located next to one another respectively form a word. Within each group, all the line segments are parallel to one another, but from word to word the directions of the respective line segments differ from one another, so that there is a plurality of words with line segments inclined differently in relation to the direction of the basic-design lines. Mutually adjacent successive lines of the basic design and mutually adjacent successive line segments have alternately different colors, preferably three different colors being represented. In an attempt to reproduce a currency paper with a multi-color safety design of this type by means of a color copier, the line segments crossing the sensing direction at a relatively large angle, above all approximately at a right angle, are reproduced more broadly and more diffusely than the line segments and lines extending approximately in the sensing direction, so that, as a result of this line spread, the corresponding words, inconspicuous in the safety design of the genuine currency paper at a fleeting glance become clearly visible.

9 Claims, 9 Drawing Sheets

CURRENCY PAPER, ESPECIALLY BANK NOTE, WITH A SAFETY DESIGN AND PROCESS FOR PRODUCING IT

FIELD OF THE INVENTION

The invention relates to a currency paper, especially a bank note, with a safety design formed from lines, according to the preamble of claim 1, and to a process for producing a safety design of this type.

PRIOR ART

A major problem in the production of bank notes as counterfeit-proof as possible is to obtain such a complex design that it cannot be reproduced directly with modern color copiers available today. For this purpose, a safety design of the type described in the preamble of claim 1 has already become known (GB-A-2,018,197), and in this the parallel lines of the basic design extend perpendicularly relative to the line segments which form the characters. This formation of a safety design makes use of the knowledge that copiers working with a light source sensing the original reproduce the lines of a line design with an intensity which depends on the angle between the direction of the lines and the direction of sensing, and specifically, according to GB-A-2,018,197, the lines extending in the sensing direction of the light source will be reproduced more sharply than the lines extending perpendicularly relative to this. Consequently, when, on the original, the lines of the basic design and the line segments forming the characters have the same width and thickness, then, on the original, the characters within the basic design cannot be discerned directly and merely give the impression of slight irregularities in the line design. In contrast, on a reproduction made with a copier of said type, the characters appear more or less clearly, because their line segments and the lines of the basic design are reproduced to a differing extent because of the different orientations in relation to the sensing direction, either said line segments being reproduced darker than the lines of the basic design, or vice versa.

SUMMARY OF THE INVENTION

The object on which the present invention is based is to provide a linear safety design, in which the above-described safety effect is improved substantially because, on the original, said characters are virtually indiscernible, but on a reproduction made with a copier the visibility of these characters is greatly improved, specifically independently of the sensing direction selected during the reproduction. Moreover, it will be possible to produce the safety design according to the invention with conventional offset or collect printing machines, such as are largely used for generating the safety background on bank notes, or also with intaglio printing machines.

To achieve the object, the invention is obtained by means of the features indicated in the defining clause of claim 1.

It has been shown that the different coloring both of the lines of the basic design and of the line segments, always with the same succession of colors of adjacent line segments and lines, greatly increases the desired safety effect. The multi-coloring causes the characters in the basic design virtually to disappear on the original, but intensifies the clarity and contrast of the characters on a copied reproduction. Specifically, as has emerged, lines sensed transversely relative to their longitudinal direction are reproduced with a more or less indefinite or even diffuse spread, this effect being color-dependent in terms of the width and intensity of the lines, so that the characters become clearly visible as a result of an irregularly increased contrast. Since there is provided a plurality of characters with line segments which are oriented differently in relation to one another from character to character, when an original is copied with the use of any sensing direction there is always at least one character available of which the line segments extend approximately perpendicular relative to the sensing direction and are therefore reproduced with a specially high contrast in relation to the surrounding basic design.

The characters are preferably letters which are combined in groups to form words, the line segments forming a word all extending in the same direction, but being oriented differently from word to word. At the same time, words themselves can all be arranged parallel to one another or else in the form of at least one circle.

The basic design can consist of lines extending in only one specific direction or can have a plurality of zones, each including characters or words and each having differently oriented lines which, in particular, form a right angle with the line segments of the included characters or words.

The process according to the invention is defined by the features of the claims. Expedient embodiments of the safety design and of its production process emerge from the remaining dependent claims.

Good results as regards safety against reproduction by color grouping have already been obtained with a two-color safety design according to the invention, and the effects can be further increased by the use of three or, if appropriate, even more colors.

BRIEF DESCRIPTION OF THE DRAWINGS

The invention is explained in detail by means of an exemplary embodiment with reference to the drawings. In these.

DESCRIPTION OF THE PREFERRED EMBODIMENTS

Figure 1:
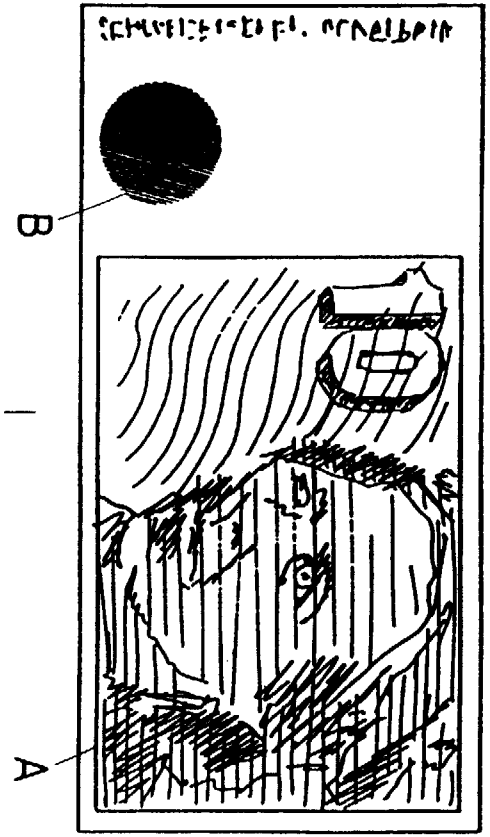
FIG. 1 shows a diagrammatic reduced representation of a bank note having a safety design B according to the invention.
Figure 7:
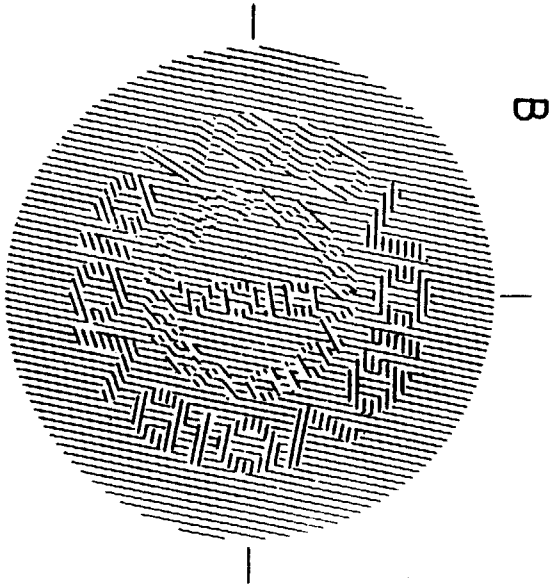
FIG. 7 shows the safety design reduced in relation to FIG. 5.
Figure 3:
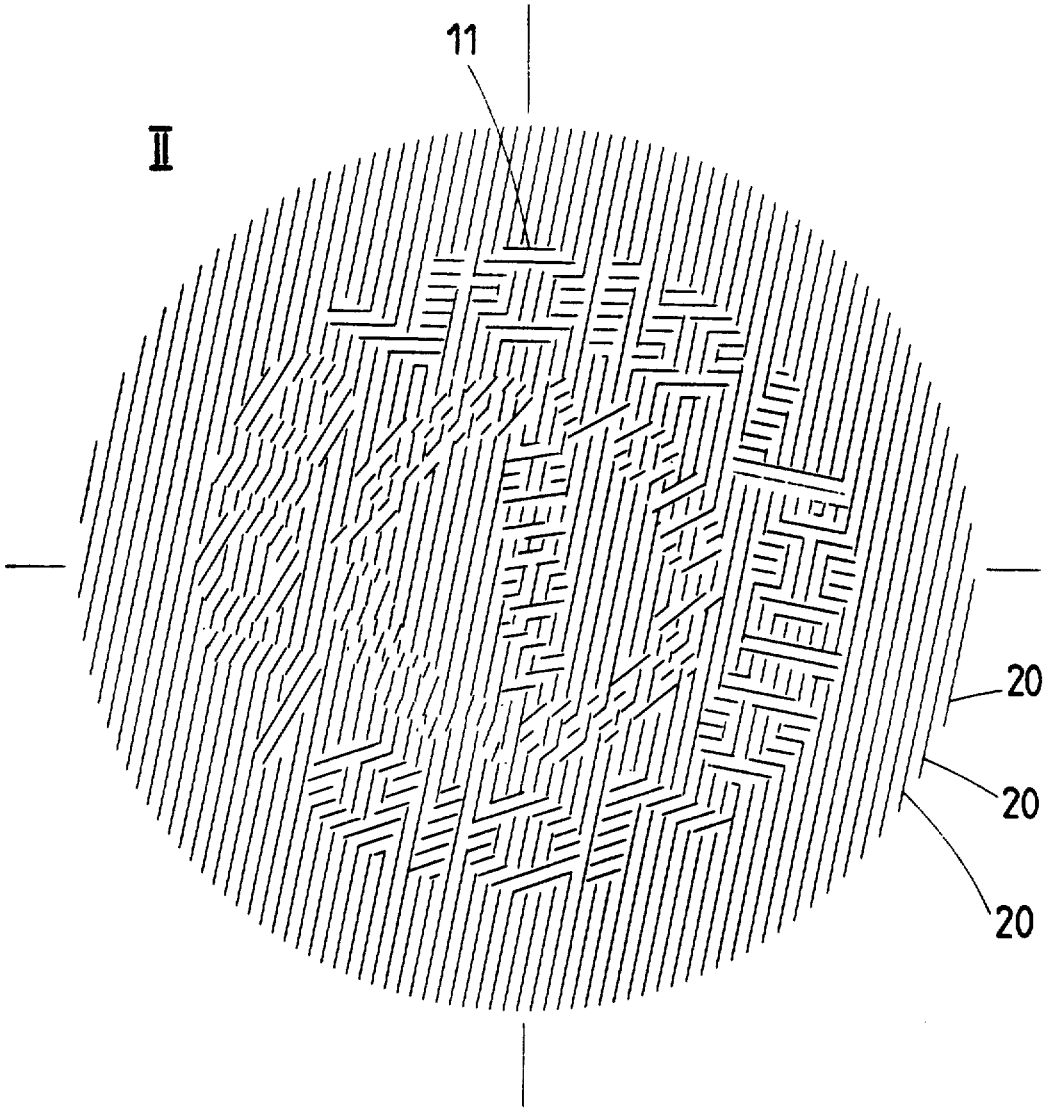
FIGS. 3 and 4 show the second part design II and the third part design III which are inked respectively with the second and third color and which, together with the first part design I according to FIG. 1, constitute the finished three-color safety design.
Figure 4:
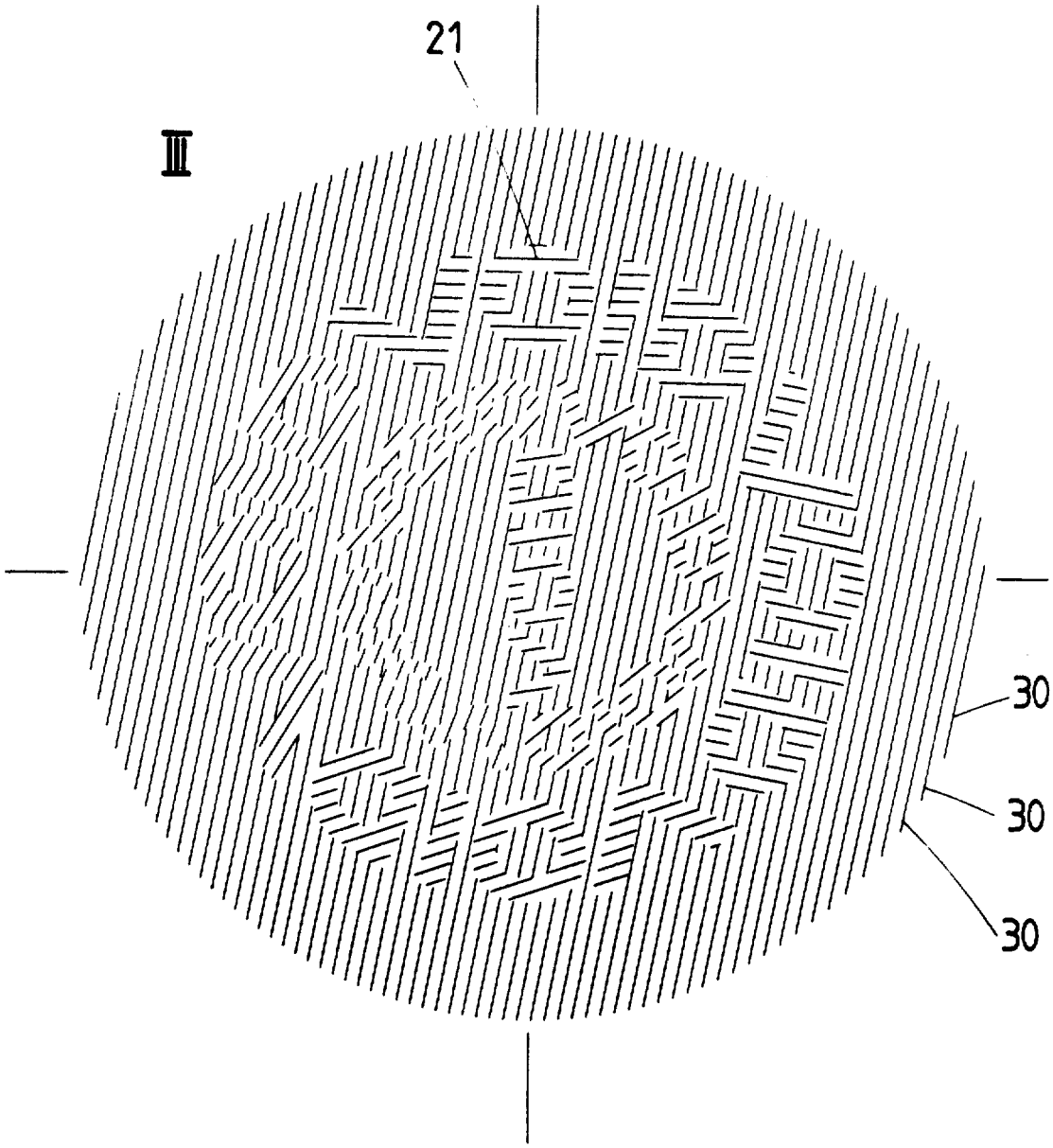
Figure 5:
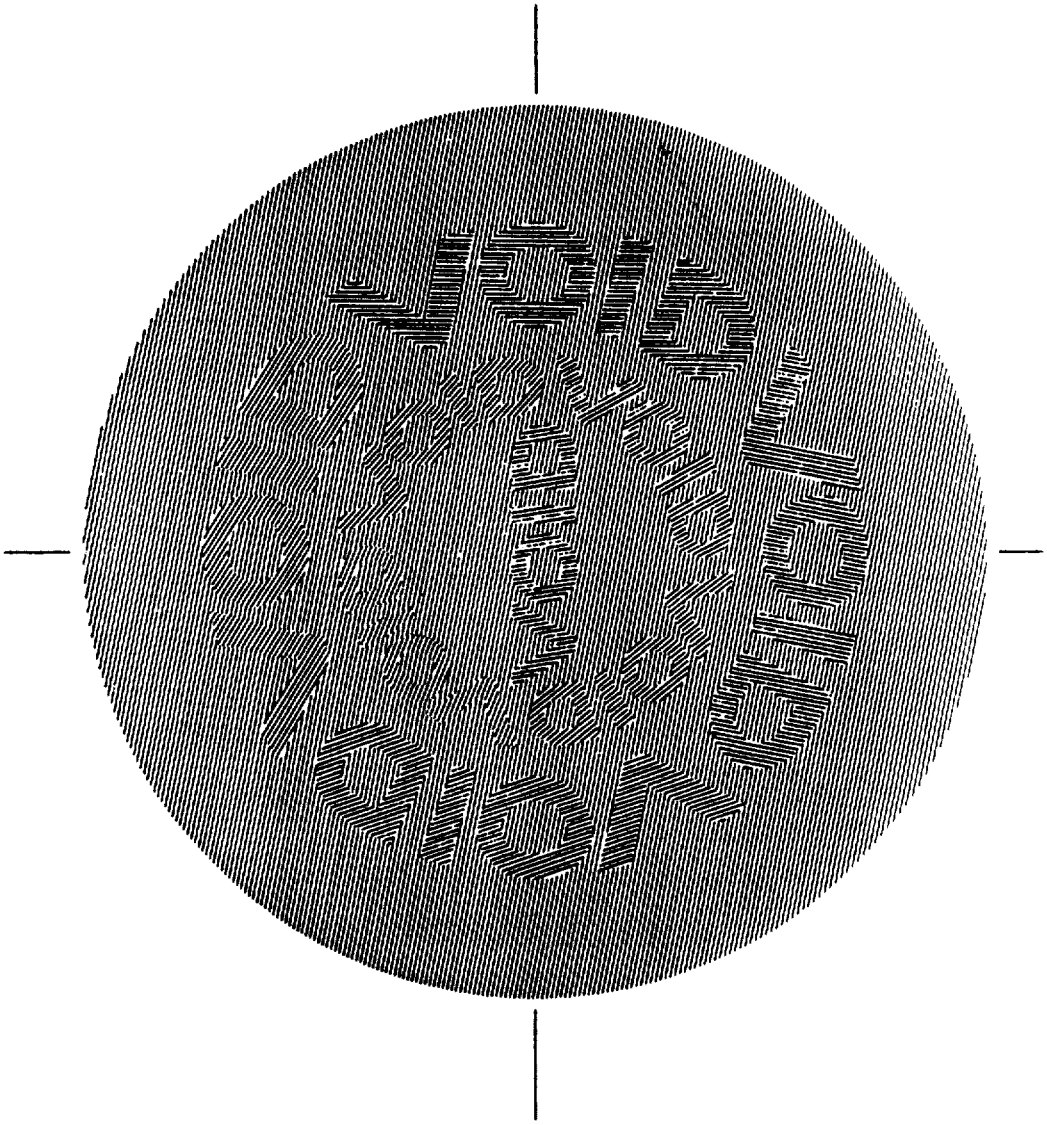
FIG. 5 shows the enlarged safety design formed as a result of the in-register composition of the three part designs according to FIGS. 2, 3 and 4.

The bank note A illustrated in FIG. 1 is equipped with a circular safety design B which is shown enlarged in FIG. 7 and enlarged even further in FIG. 5. In the instance under consideration, it is a three-color safety design composed of the three part designs I, II, III which are each inked with a specific color and which are shown in FIGS. 2, 3 and 4.

Figure 2:
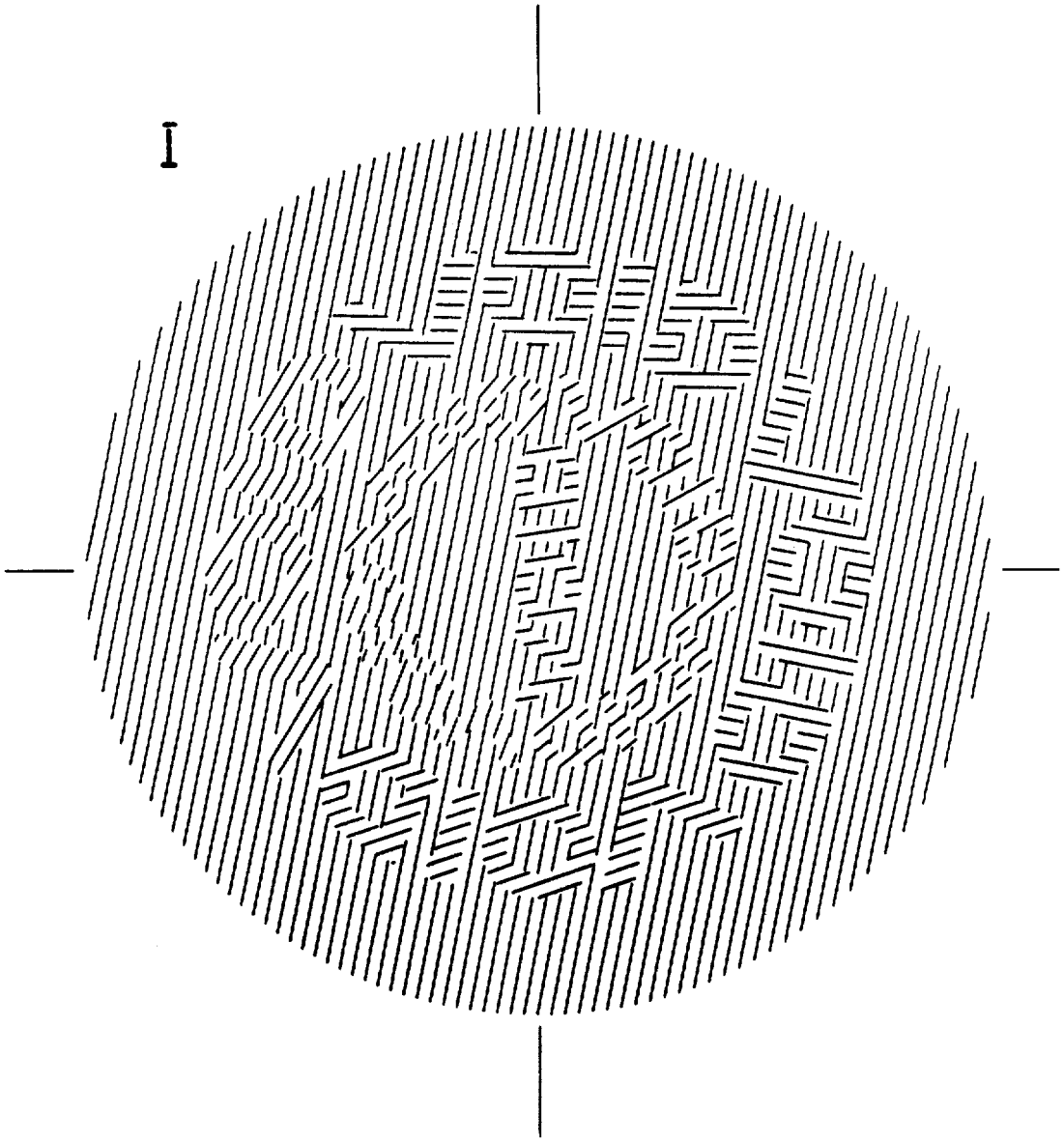
FIG. 2 shows, greatly enlarged, the first part design I, to be inked in a specific color, of a three-color safety design.

To gain an impression of such a part design undisturbed by reference lines, the first part design I is shown in FIG. 2 without any further labelling. The details of the first part design I are explained by reference to FIG. 2*a* which shows the same part design as FIG. 2. This part design has a basic design consisting of straight, parallel and equidistant lines 10 extending in a specific direction. A plurality of interruptions of these lines 10 mark out regions in the form of characters which, in the example under consideration, are letters, of which a respective group of four letters located next to one another forms the word "VOID".

Figure 2A:
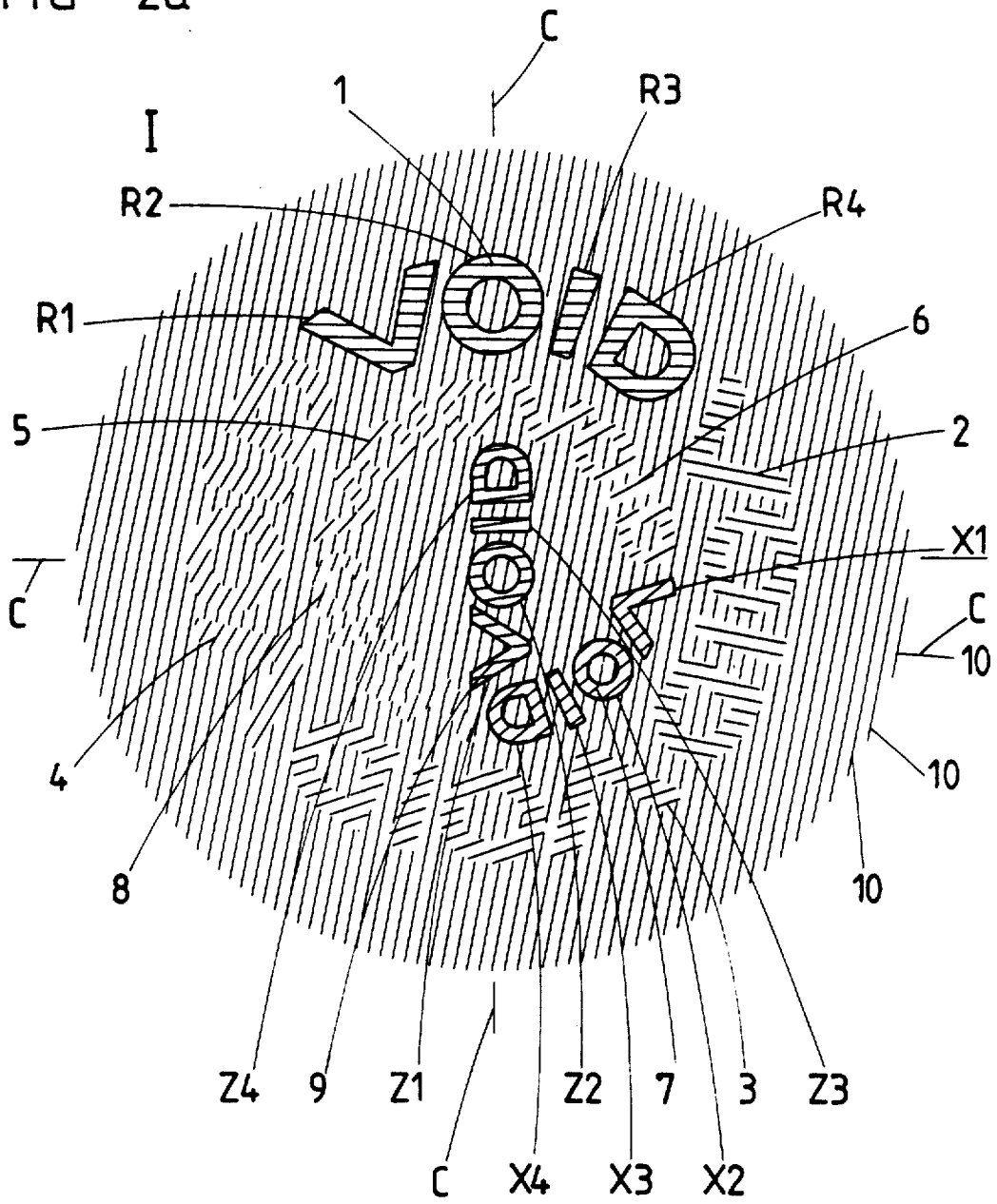
FIG. 2*a* shows the same part design I as in FIG. 2, but with reference symbols and with regions marked for the sake of illustration.
Figure 5A:
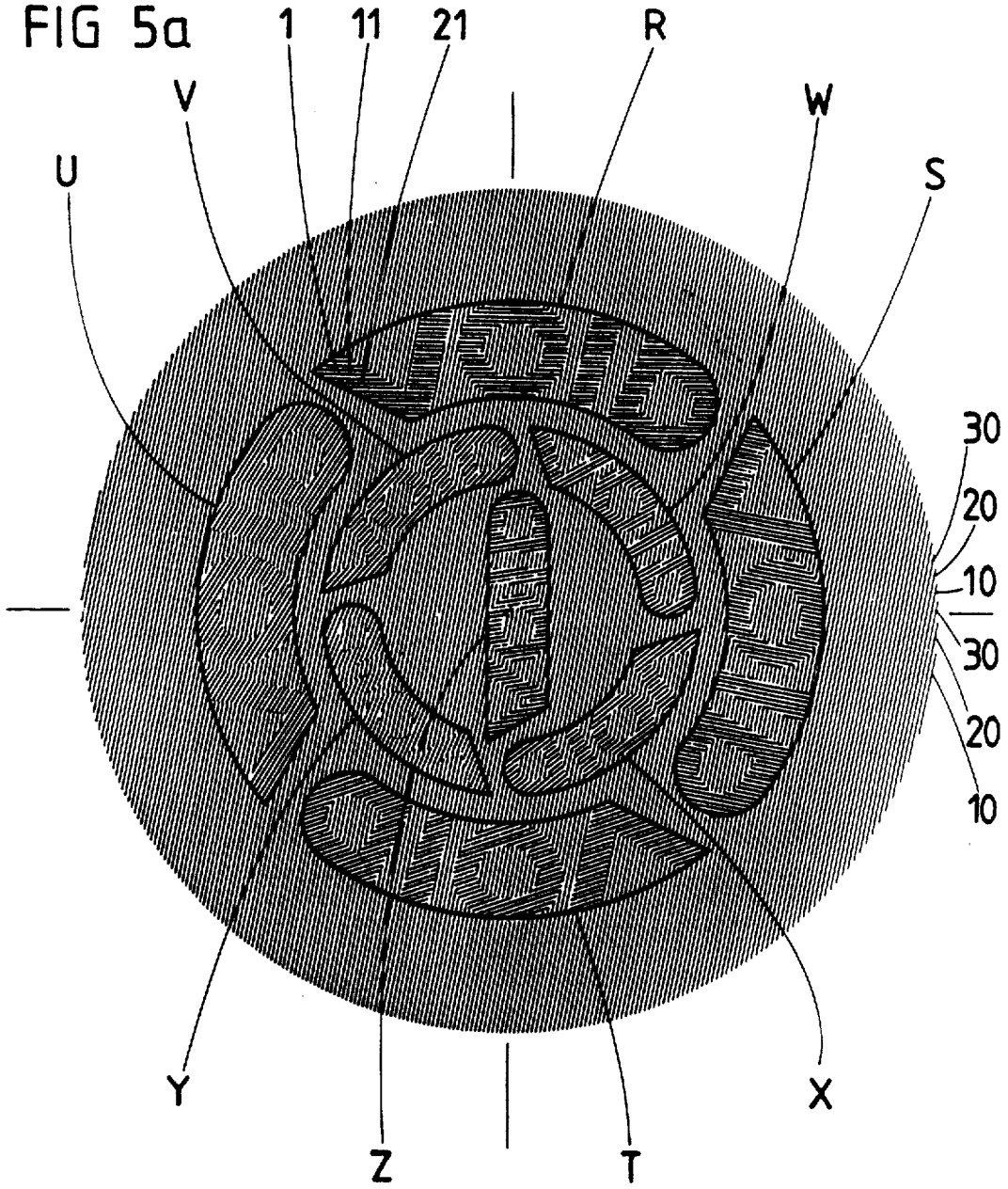
FIG. 5*a* shows the same safety design as in FIG. 5, but with reference symbols and with regions marked for the sake of the illustration.

For the sake of illustration, in FIG. 2*a* the groups with the four regions R1 to R4, X1 to X4 and Z1 to Z4, each forming said word "VOID" in different sizes and orientations, are provided with borders. Altogether the part design I contains nine groups, each with four regions respectively forming the word "VOID". Four groups, designated by R, S, T, U in FIG. 5*a*, are located on an outer circle and are formed by respective differently oriented line segments, 1, 2, 3 and 4; four further groups with smaller regions, designated by V, W, X, Y in FIG. 5*a*, are located on an inner circle and are formed respectively by the differently oriented line segments 5, 6, 7 and 8; the ninth group with the regions Z1 to Z4, designated by Z in FIG. 5*a*, is located diametrically at the centre of the circles and is formed by the line segments 9.

The various orientations of the line segments 1 to 9 are distributed approximately uniformly over an angular sector of 90°, the line segments 8 intersecting the basic-design lines 10 at an angle of approximately 10°, and the line segments 4, 5, 7, 6, 3, 9, 1 and 2 intersecting them at an angle of approximately 20°, 30°, 40°, 50°, 60°, 70°, 80° and 90° respectively. The orientations of the line segments 1 to 9 therefore differ by angular intervals of approximately 10°. Of course, for the desired effects, inclinations of the line segments relative to the basic-pattern lines of 100° are equivalent to inclinations of 80°, the line segments inclined at 110° are equivalent to the line segments inclined at 70°, and so on and so forth. In general, the angles which the line segments of specific regions or of region groups constituting a particular word formed with the basic-pattern lines can increase at angular intervals of 5° to 20°, so that over an angle of 90° there are at least four regions or region groups with orientations distributed approximately uniformly over this region. Advantageously, however, there are different orientations of the line segments at smaller angular intervals.

The thickness of the lines 10 and of the line segments 1 to 9 can be in the range of 0.01 to 0.10 mm, preferably 0.03 to 0.06 mm, and, in the exemplary embodiment under consideration, amounts to approximately 0.04 mm on the original design. The spacings between the lines and line segments in the part design are selected in such a way that these can be interleaved with the corresponding lines and line segments of the other two part designs, whilst at the same time ensuring a sufficient spacing. In the example under consideration, this spacing in the part design according to FIG. 2*a* is approximately thirty times the line thickness, so that in the composed safety design the spacings amount approximately to ten times the line thickness, that is to say approximately 0.4 mm. In general, in the finished safety design these spacings can amount to five to fifteen times the line thickness.

In FIG. 2 and 2*a* and in FIGS. 3 and 4, four register marks, designated by C in FIG. 2*a*, are shown at the edge of the part design.

FIGS. 3 and 4 illustrate the other two part designs II and III with the same general line configuration consisting of basic-design lines 20 and 30 and of the corresponding regions with differently inclined line segments, of which only the line segments corresponding to the regions R1 to R4 are given the reference numeral 11 in FIG. 3 and only the line segments corresponding to the same regions the reference numeral 21 in FIG. 4. The part design II differs from the part design I in that all the lines and line segments are offset relative to those of the part design I by the amount of one third of the line spacing. Likewise, the part design III differs from the part design II in that its lines and line segments are offset relative to those of the part design II by the amount of one third of the line spacings. In the example under consideration, it will be assumed that the part design I has red, the part design II green and the part design III violet lines and line segments.

FIG. 5 and 5*a* illustrate the safety design which is composed in register from the three part designs I, II and III and which is therefore obtained when all three part designs are combined, with their register marks C lying exactly on top of one another. In mutually adjacent successive lines and line segments, three said colors alternate respectively in the same sequence, as indicated by the line sequence 10, 20, 30, etc. and the sequence of line segments 1, 11, 21, etc. in FIG. 5*a* which shows the same safety design as FIG. 5. As is evident at once, no particular characters or letters stand out upon a fleeting glance at the safety design according to FIG. 5, the less so when it is remembered that FIG. 5 is a greatly enlarged representation of the safety design, whereas its actual size on a bank note is only a fraction, for example approximately a quarter or a fifth of this. In such a reduction, no specific characters or letters in the safety design can be seen, only a certain disorder or irregularity in the line design being discernible. In FIG. 5*a*, for the sake of illustration the nine character groups R, S, T, U, V, W, X, Y and Z normally invisible in practice are marked by borders.

Now when the complete three-color safety design is reproduced by means of a commercial color copier, then the thin colored lines crossing the sensing direction of this copier are not reproduced correctly, but spread or smudge somewhat, this sp ding depending on the angle of inclination of the line segments in relation to the sensing direction and also on the line color. If the line segments cross the sensing direction at an angle of 90°, the effect is at its most pronounced.

Figure 8:
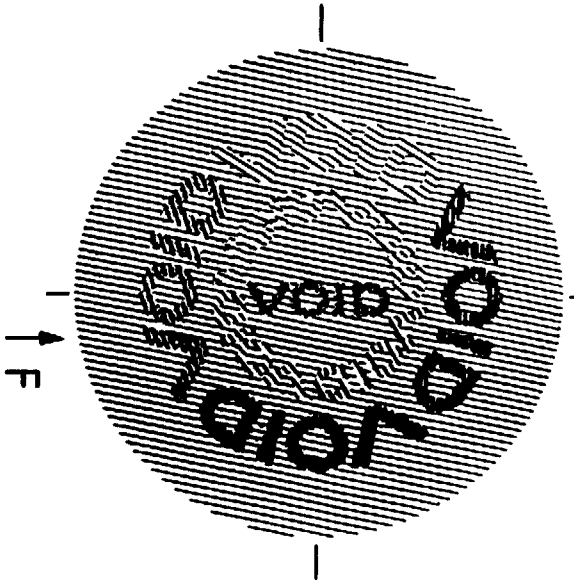
FIG. 8 shows the copy, reduced in relation to FIG. 6, of a reproduced safety design.
Figure 6:
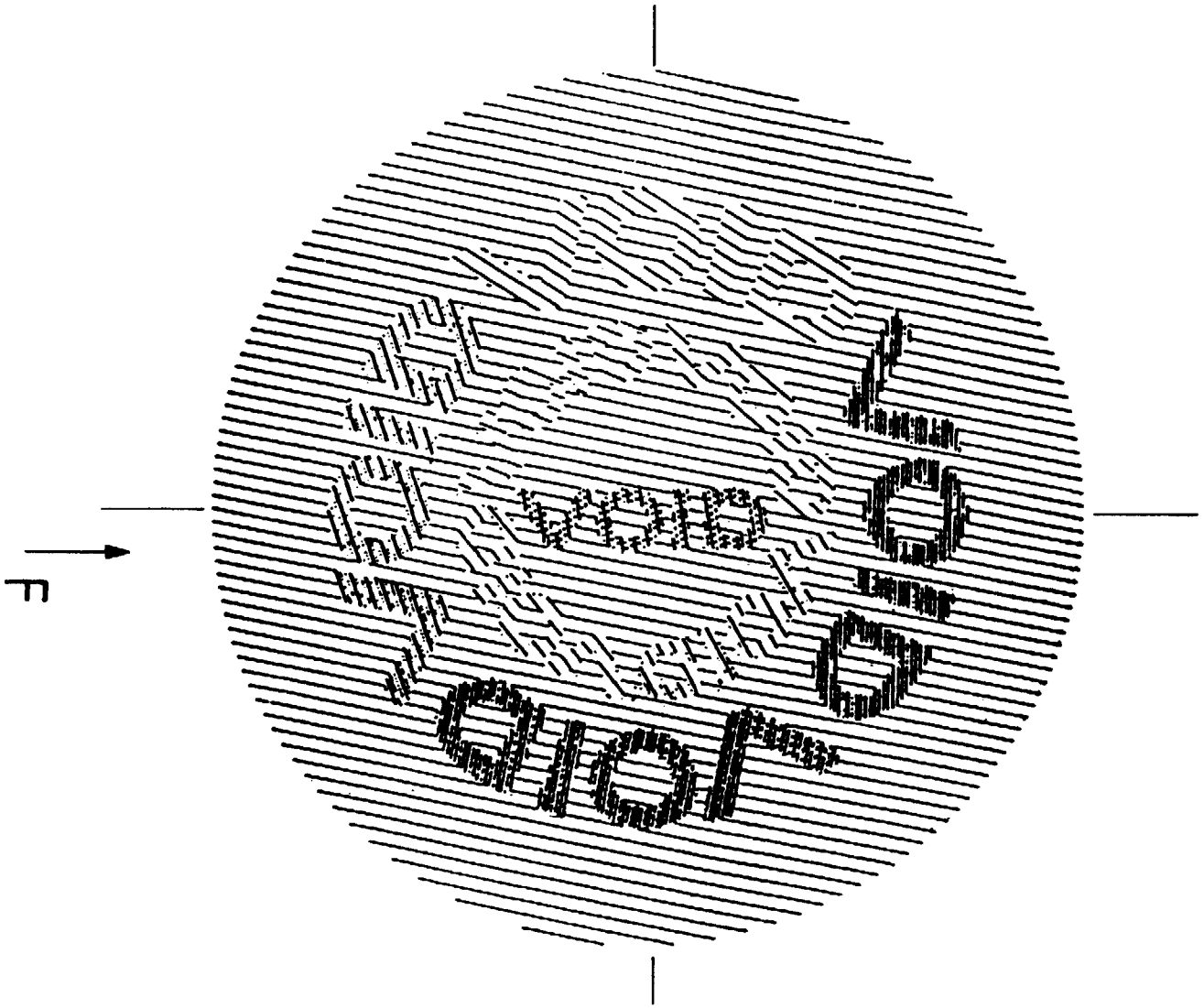
FIG. 6 shows a copy, enlarged on the same scale, of a multi-color safety design according to FIG. 5 reproduced with a color copier, the sensing direction being indicated by the arrow F; it can be seen that some words have become clearly visible; however, the black-and-white copier used to produce this copy could generally only reproduce clearly the lines of one color, so that because of the missing lines the line spacing of the basic-design lines appears larger than it is in reality.

FIGS. 6, 7 and 8 explained below relate to photocopies of the three-color originals of the safety design which are produced by means of a black-and-white copier, FIG. 8 being a copy of the colored reproduction, obtained with a color copier, of the colored original design and FIG. 6 being an enlargement of this. With this black-and-white copying, essentially only the lines of a specific color, in this particular case the red lines, have been reproduced correctly, whereas the other two colors have not been reproduced or reproduced only nowhere near completely, thereby giving the impression that there are fewer basic-design lines and line segments located at a greater distance from one another than is true in reality according to FIG. 5. However, the decisive effects are nevertheless illustrated clearly, especially because the line segments spread on the colored originals are reproduced essentially completely or are at least indicated on the copies according to FIG. 6 and FIG. 8.

FIG. 6 shows an enlarged black-and-white copy of a reproduction, obtained with a color copier, of the colored safety design according to FIG. 5, with sensing in the direction of the arrow F, that is to say at a small angle of approximately 10° in relation to the basic-design lines 10, 20, 30. On this reproduction, therefore, thickened lines emphasise clearly those words "VOID" of which the line segments form with the sensing direction F a larger angle, especially approximately a right angle, as is true of the line segments designated by 1 and 2 in FIG. 2*a*, this corresponding to the groups R and S according to FIG. 5*a*. The effect is also visible to a lesser extent in the line segments 3 and 9 corresponding to the groups X and Z according to FIG. 5*a*. The effect emerges even more clearly in the representation according to FIG. 8 reduced in relation to FIG. 6. For comparison, FIG. 7 shown on the same scale, without any counterfeit effects, the safety design which corresponds to FIG. 5.

Since, as mentioned, the safety design has regions with line segments which assume all possible orientations at intervals of approximately 10°, this guarantees that, in an attempt to reproduce the safety design with a color copier, at least some of the word groups become clearly visible in any selected sensing direction.

Figure 9:
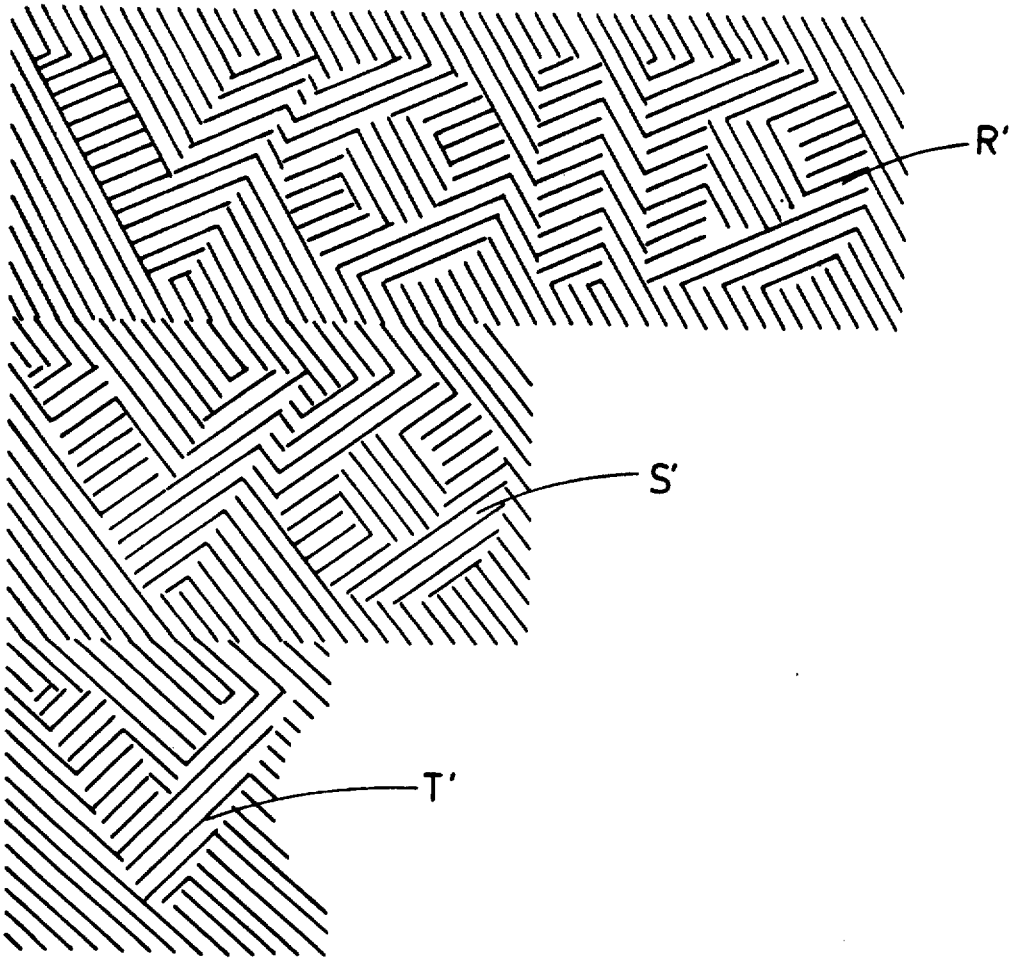
FIG. 9 shows part of a safety design of another form.

FIG. 9 shows part of a safety design with a plurality of words "VOID" arranged parallel to one another, each word R', S', T' consisting of parallel line segments, the orientation of which changes by a small angle from word to word. Each of the words is located within a respective basic design of rectangular form, the lines of which each have a direction other than that of the adjacent basic designs, in the example under consideration the line segments forming a word always forming a right angle with the lines of the surrounding basic design. The complete design has, of course, more words, for example six to eight, in which the directions of the line segments are distributed approximately uniformly within 90°. Once again, the lines and line segments have the same color sequence, for example red and blue alternately, or a sequence of a plurality of colors.

The safety design according to the invention can be produced by various known printing processes, especially by the offset printing process or a color-collect printing process. Where the offset printing process is concerned, a special offset printing plate is made as a part-design carrier for each part design and is mounted on a plate cylinder. The number of these part designs and printing plates corresponds to the number of different colors of the safety design. All the part designs, each inked with a specific color, are transferred in register from the printing plates onto the offset blanket cylinder common to all the plate cylinders, composed there to form the complete design and transferred from this offset blanket cylinder onto the paper. Multi-color offset printing machines of this type are described, for example, in EP-B-0 092 887 and EP-B-0 132 858. The process can involve either dry-offset printing or indirect typographic printing, with the use of typographic plates, or wet-offset printing. In the last case, it is possible to use conventional wet-offset printing plates or else gravure printing plates, especially engraved intaglio printing plates of which the surface, outside the depressions, is dampened by the dampening unit of the wet-offset machine and is thereby made ink-repellant.

In the color-collect printing process likewise described, for example, in EP-B-0 092 887, the complete printing design, that is to say, in the present case, the complete safety design, is located on a single collect printing plate which is inked multi-color by a color-collect cylinder in the form of a blanket cylinder. This color-collect cylinder is itself inked by a plurality of selective color inking cylinders which form a kind of part-design carrier and of which the number corresponds to the number of colors and each of which carries cut-out relief zones; these relief zones correspond to the part designs on the collect printing plate which are each to be inked with a specific color. Each selective color inking cylinder is therefore inked by its own inking unit. The multi-color design of the collect printing plate is then transferred onto the paper. This process, also called the "Orlof" process, produces a multi-color design with a perfect register between the part designs inked with different colors. At the same time, the collect printing plate can be a typographic printing plate, if appropriate also a wet-offset printing plate or else advantageously, as described in EP-B-0 091 709, an intaglio printing plate which is inked by the color-collect cylinder and which carries the complete safety design in the form of engraved lines. If a typographic printing plate or wet-offset plate is used as collect printing plate, the safety design is generally transferred onto the paper via a blanket cylinder. If an intaglio printing plate is used, the multi-color safety design is transferred directly onto the paper. In this case, the intaglio printing plate having the safety design in the form of linear intaglio grooves can at the same time also carry other designs or images, especially a main design which is inked directly in the conventional way by an appropriate stencil cylinder.

Finally, the safety design according to the invention can also be produced by a conventional multi-color intaglio printing machine, in which the intaglio printing plate has the entire linear safety design and is inked by stencil cylinders which in this case constitute a kind of part-design carrier. The stencil cylinders have raised zones which correspond to the part-designs on the printing plate which are each to be inked with a specific color. A multi-color intaglio printing machine of this type is described, for example, in Swiss patent specification 566 210.

The safety design according to the invention is not restricted to the exemplary embodiment described, but permits many alternative versions in terms of its construction, and the number and form of the characters which are formed by line segments respectively arranged at different inclinations.

I claim:

1. A currency paper, especially a bank note, with a safety design formed from lines and consisting of at least one flat basic design composed of parallel straight lines (10, 20, 30) with interruptions, by means of which regions (R1 to R4, . . . , X1 to X4, . . . , Z1 to Z4) in the form of specific characters are marked out, and of parallel straight line segments (1 to 9, 11, . . . , 21, . . . ) which fill these interruptions and which have a direction different from the direction of the basic-design lines (10, 20, 30), wherein basic-design lines (10, 20, 30) located next to one another and line segments (1 to 9, 11, . . . , 21, . . . ) located next to one another in said regions have alternately different colors in the same periodic color sequence, and wherein, in a plurality of regions, the directions of the line segments are different from region to region and are distributed at least approximately uniformly within an angular sector of 90°.

2. The currency paper as claimed in claim 1, wherein, in said plurality of regions, the directions of the line segments change at angular intervals of 5° to 20°, preferably of approximately 10°.

3. The currency paper as claimed in claim 1 or 2, wherein the basic design consists of lines (10, 20, 30) extending in only one specific direction.

4. The currency paper as claimed in claim 1 or 2, wherein at least some of the characters or some character groups are located within a respective basic design, the lines of which have a direction other than that of the adjacent basic designs.

5. The currency paper as claimed in claim 1 wherein the characters have the form of letters and a plurality of groups (R to Z) of letters located next to one another and constituting a respective word is provided, and wherein all the line segments forming a word have the same direction, but are oriented differently in relation to one another from word to word.

6. The currency paper as claimed in claim 5, wherein at least some of said words are arranged parallel to one another.

7. The currency paper as claimed in claim 5 or 6, wherein at least some of said words are arranged next to one another in the form of at least one circle (R, S, T, U and V, W, X, Y), and in that preferably at least one further word (Z) is arranged diametrically in relation to this circle.

8. The currency paper as claimed in claim 1 wherein the lines and line segments have a thickness of 0.01 to 0.10 mm, preferably 0.03 to 0.06 mm, and wherein the spacings of mutually adjacent lines or line segments amount to 5 times to 15 times, preferably approximately 10 times the line thickness.

9. The currency paper of claim 1 wherein said basic design lines and said line segments are arranged in the same color sequence.

* * * * *